United States Patent [19]

Kobayashi et al.

[11] Patent Number: 4,862,847

[45] Date of Patent: Sep. 5, 1989

[54] APPARATUS FOR SUPPLYING START-FUEL IN THE INTERNAL COMBUSTION ENGINE FOR A PORTABLE TYPE WORKING MACHINE

[75] Inventors: Takeshi Kobayashi, Yokohama; Kohji Nagasaka, Kawasaki; Yoshimi Sejimo, Urayasu, all of Japan

[73] Assignee: Walbro Far East, Inc., Kawasaki, Japan

[21] Appl. No.: 238,286

[22] Filed: Aug. 29, 1988

[30] Foreign Application Priority Data

Sep. 7, 1987 [JP] Japan ..... 62-223758

[51] Int. Cl.[4] ..... F02M 1/10

[52] U.S. Cl. ..... 123/187.5 R; 123/180 E; 123/180 P; 123/180 T; 261/DIG. 8

[58] Field of Search ..... 123/187.5 R, 180 E, 123/180 P, 180 T; 261/DIG. 8

[56] References Cited

U.S. PATENT DOCUMENTS 3,371,658 3/1968 Turner ..... 123/187.5 R
4,373,479 2/1983 Billingsley et al. ..... 123/187.5 R
4,508,068 4/1985 Tuggle et al. ..... 123/187.5 R
4,676,204 6/1987 Inoguchi et al. ..... 123/180 P

FOREIGN PATENT DOCUMENTS 59-54758 3/1984 Japan ..... 123/187.5 R

*Primary Examiner*—Andrew M. Dolinar
*Attorney, Agent, or Firm*—Barnes, Kisselle, Raisch, Choate, Whittemore & Hulbert

[57] ABSTRACT

An apparatus for supplying a start-fuel to an internal combustion engine for a portable type machine such as a chain saw or brush cutter which has an electric battery for use in starting. An electrically driven primer pump is connected to the metering chamber of a diaphragm carburetor and can direct fuel from the chamber to an accumulator which is connected to a fuel tank through a relief valve and also to a fuel jet in the venturi entrance of the carburetor. When the primer pump is actuated by a key switch, as the engine is started, fuel in the metering chamber is moved to the accumulator and fuel is replenished from the fuel tank. Also, an electromagnetic valve opens the accumulator to the fuel jet to furnish start-fuel to the venturi.

5 Claims, 2 Drawing Sheets

APPARATUS FOR SUPPLYING START-FUEL IN THE INTERNAL COMBUSTION ENGINE FOR A PORTABLE TYPE WORKING MACHINE

REFERENCE TO RELATED APPLICATION

Reference is made to the following simultaneously filed United States application which is assigned to an assignee common to the present application: Ser. No. 237,946—Filed Aug. 24, 1988.

FIELD OF THE INVENTION

The present invention relates to an apparatus for supplying a start-fuel in an internal combustion engine for a portable type working machine.

BACKGROUND AND FEATURES OF THE INVENTION

A small two-cycle internal combustion engine used a driving source for portable working machines such as a chain saw, a brush cutter and the like is equipped with a diaphragm type carburetor so that excellent operation of the internal combustion engine may be controlled in any attitude.

As disclosed in Japanese Patent Application Laid-Open Publication No. 41955/1987, there is proposed an arrangement wherein when the engine is started, fuel is supplied from a fuel tank to a metering chamber by a manual primer pump, the fuel being also directed to an accumulator chamber, and a button for an accumulator is operated simultaneously with the starting rotation (cranking) operation of the engine to supply the fuel in the accumulator from a fuel nozzle to an air intake passage of a carburetor. However, recently, the internal combustion engine equipped with a battery operated motor has been mounted on the aforementioned portable working machine. It is desirable that an electric power supply for driving the electric motor is also utilized to automatically perform a series of operations.

It is an object of the present invention to provide an apparatus for supplying start-fuel to the internal combustion engine for a portable type working machine in which replenishing of fuel to a metering chamber and supplying of start-fuel to a fuel nozzle are automatically accomplished by an electric primer pump.

BRIEF DESCRIPTION OF THE INVENTION

Figure 1:
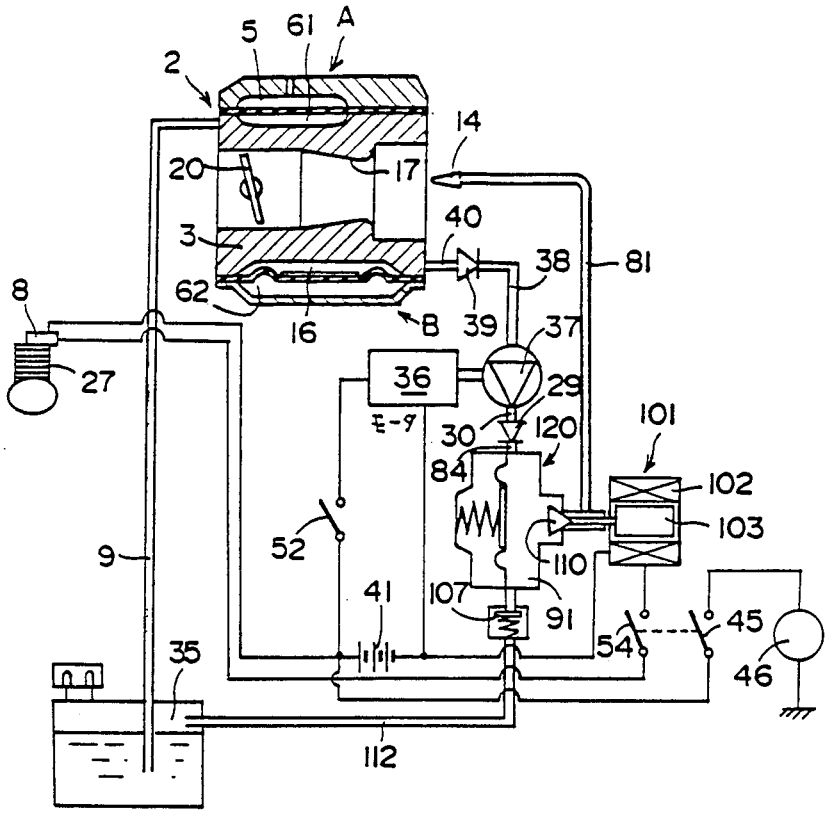
FIG. 1 is an entire structural view of an apparatus for supplying start-fuel in the internal combustion engine for a portable working machine according to the present invention.

For achieving the aforesaid object, the present invention provides an arrangement wherein a metering chamber of a diaphragm type carburetor is connected to an accumulator via an electric primer pump, said accumulator being connected to a fuel tank via a relief valve and connected to a fuel nozzle disposed in an air intake passage of a carburetor via an electromagnetic valve.

DETAILED DESCRIPTION OF THE INVENTION AND THE MANNER AND PROCESS OF USING IT

When an electric primer pump 37 is driven prior to starting of the engine, fuel from a metering chamber 16 of a fuel supply mechanism B is drawn into the primer pump via a passage 40, a check valve 39 and a passage 38, and further moved into an accumulator 120 via a passage 30, a check valve 29 and a pipe 84. Surplus fuel is returned to a fuel tank 35 via a relief valve 107 and a pipe 112. Accordingly, the metering chamber 16 assumes a negative pressure state, and fuel in a fuel tank 35 is replenished to the metering chamber 16 via a pipe 9, a pump chamber 61 of a diaphragm type fuel pump A, a passage 60 (FIG. 2) and an inlet valve 10.

Subsequently, when an electromagnetic valve 101 is opened simultaneously with cranking of the engine 27 caused by a battery operated electric motor 46, fuel in the accumulator 120 is injected from a fuel nozzle 14 to an air intake passage 17 via a pipe 81. In this manner, at the time of starting, a rich mixture is created in a carburetor 2 and sent to the engine 27 to insure a positive start of the engine 27.

FIG. 1 shows a schematic structure of an apparatus for supplying start-fuel to an internal combustion engine according to the present invention. The start-fuel supplying apparatus comprises an electric primer pump 37, an accumulator 120 connected between the primer pump 37 and a fuel tank 35, and a fuel nozzle 14 disposed in an air intake passage 17 of a carburetor 2. As the primer pump 37, for example, a rotation type pump such as a gear pump or a vane pump driven by a motor, or an electromagnetic pump may be used. In the illustrated embodiment, the primer pump 37 is driven when a motor 36 is energized by a battery 41 through a pump switch 52. An accumulator 120 is provided with an electromagnetic valve 101 for supplying fuel to the fuel nozzle 14, the electromagnetic valve 101 being opened when a solenoid 102 is energized by the battery 41 via a thermo-switch or temperature switch 8 (FIG. 2) disposed on the external portion for the engine and a start switch 54. The start switch 54 is operatively interconnected to a key switch 45 for driving the motor 46.

The carburetor 2 is provided at the upper portion with a fuel pump A in which a pulsating pressure introducing chamber 5 and a pump chamber 61 are defined by a diaphragm 6. At the lower portion of the carburetor is a fuel supply mechanism B in which a metering chamber 16 and an atmospheric chamber 62 are defined by a diaphragm 11. In the normal operation of the engine, fuel in the fuel tank 35 is drawn into the fuel pump A via a pipe 9 and then sent to the metering chamber 16 and fuel in the metering chamber 16 is drawn into the air intake passage 17 via a fuel jet 24 by the negative pressure of the air intake passage 17.

When the primer pump 37 is driven prior to starting of the engine, fuel in the metering chamber 16 is drawn into the primer pump 37 via a passage 40, a check valve 39 and a passage 38, and further directed to an accumulator 120 via passage 30, a check valve 29 and a pipe 84. Surplus fuel is returned to a fuel tank 35 via a relief valve 107 and a pipe 112. In this manner, when the metering chamber 16 assumes a negative pressure state, fuel in a fuel tank 35 is replenished to the metering chamber 16 via a pipe 9, a pump chamber 61 of fuel pump A and a passage 60.

At the time of starting the engine, when the electromagnetic valve 101 is opened and the motor 46 is driven, fuel in the accumulator 120 is injected as start-fuel from the fuel nozzle 14 to the air intake passage 17 via a pipe 81.

Under conditions when the ambient temperature of the engine 27 is a temperature at which starting is difficult (at cold season), the temperature switch 8 remains closed, but at the normal temperature the temperature switch 8 is opened and no start-fuel is injected from the fuel nozzle 14.

Figure 3:
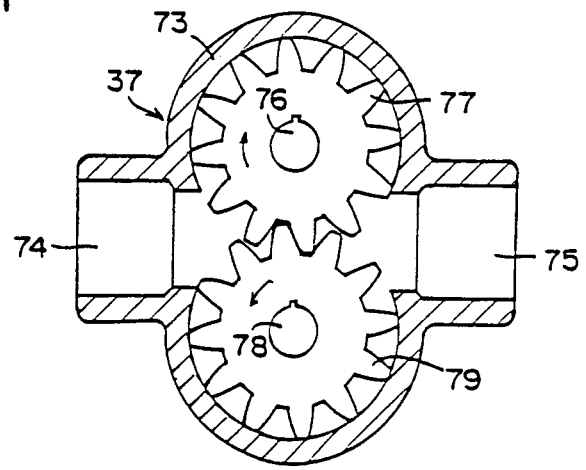
FIG. 3 is a sectional plan view showing one example of a primer pump.

As shown in FIG. 3, a gear pump, for example, as the primer pump 37, has a casing 73 which accommodates therein gears 77 and 79 supported on shafts 76 and 78, respectively, and engaged with each other. When one of the shafts 76 and 78 is normally rotated (in a direction indicated by arrow) by a motor 36 (FIG. 1), fuel is drawn through an opening 74 and discharged out of an opening 75 passing the outside of the gears 77 and 79.

Figure 2:
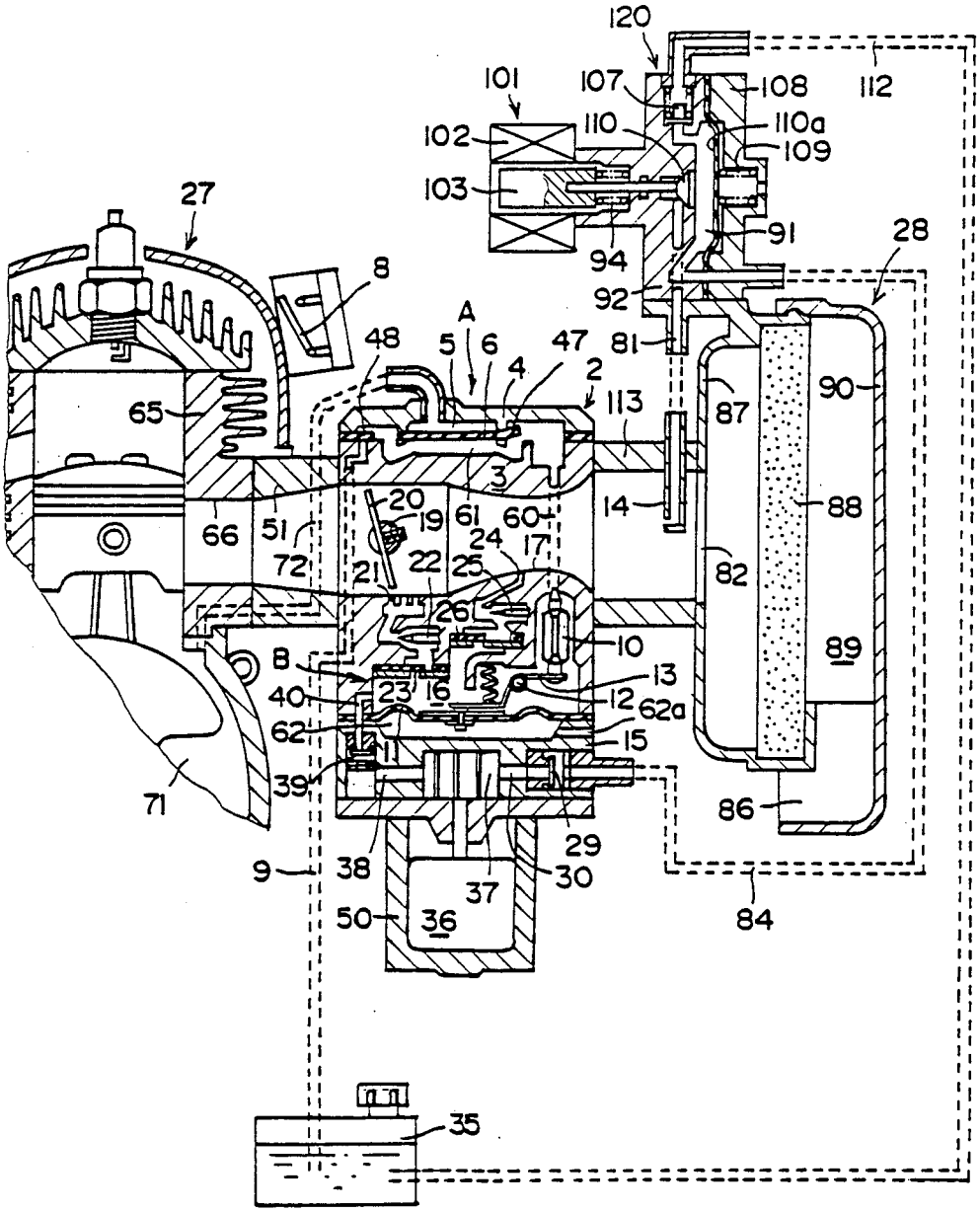
FIG. 2 is a sectional side view showing the detailed construction of the apparatus.

FIG. 2 shows the details of the carburetor 2 integrally provided with the primer pump 37, a fuel accumulator 120 and a fuel nozzle 14 leading to the engine 27. On the engine 27 is mounted the diaphragm type carburetor 2 and an air cleaner 88 in muffler 28 through an intake pipe 51 formed of a heat insulating material on the side wall of a cylinder 65. A pipe 9 from the fuel tank 35 is connected to an inlet side of the fuel pump A of the carburetor 2.

In the carburetor 2, an air intake passage 17 including a venturi in the body 3 is communicated with an intake port 66 provided in an engine cylinder 65. Interiorly of the air intake passage 17 a well-known throttle valve 20 is rotatably supported by a valve shaft 19.

The muffler 28 containing the air cleaner 88 includes a housing 87 attached to a pipe 113 at the inlet of the carburetor 2. The housing has an air inlet 86 in a cover cap 90 with a rib 89 to support the air cleaner. The housing 87 has an outlet 82 open to pipe 113 leading to the carburetor venturi passage 17.

A cover 4 is coupled to the upper wall of the body 3 with a diaphragm 6 disposed therebetween, and a cover 15 is coupled to the lower wall of the body with a diaphragm 11 disposed therebetween. The cover 4 is provided with a pulsating pressure introducing chamber 5, which is connected to a crank chamber 71 of the engine 27 through a pipe 72. A pump chamber 61 defined by the diaphragm 6 is connected to a pipe 9 via a check valve 48. The pump chamber 61 is connected to the metering chamber 16 via a check valve 47, a passage 60 and an inlet valve 10.

An atmospheric chamber 62 between a diaphragm 11 defining the metering chamber 16 and a cover 15 is opened to the atmosphere by a passage 62*a*. The inlet valve 10 in the form of a needle valve is disposed on the end of the passage 60 and is opened and closed by a lever 13 supported on the wall of the metering chamber 16 by a shaft 12. One end of the lever 13 is biased into engagement with the end of the inlet valve 10 by means of the force of a spring. The other end of the lever 13 is forced in abutment with a projection coupled to an approximate center of the diaphragm 11. The metering chamber 16 is connected to a high-speed fuel jet 24 via a check valve 26 and a high-speed fuel metering needle valve 25. The metering chamber 16 is also connected to a low-speed fuel jet 21 via a check valve 23 and a low-speed fuel metering needle valve 22.

To the cover 15 is coupled a housing 50 in the underside of the cover 15 which accommodates a motor 36 coupling the shaft of the primer pump 37. The primer pump 37 is accommodated within the housing integrally formed within the cover 15. An inlet of the primer pump 37 is connected to the metering chamber 16 via a passage 38, a check valve 39 and a passage 40. An outlet of the primer pump 37 is connected to the accumulator 120 via a passage 30, a check valve 29 and a pipe 84.

The accumulator 120 defines a chamber 91 with a diaphragm 110*a* sandwiched between a housing 92 and a cover 108. A spring 109 is interposed between the diaphragm 110*a* and the cover 108. The chamber 91 is connected to a fuel tank 35 via a relief valve 107 and a pipe 112. The chamber 91 is connected to the fuel nozzle 14 via an electromagnetic valve 101 and a pipe 81. In the electromagnetic valve 101, a valve body 110 is connected to a plunger 103 disposed coaxially with a solenoid 102, and a passage for connecting the chamber 91 with the pipe 81 is normally closed by the valve body 110 through a spring 94.

The fuel nozzle 124 is disposed approximately centrally on the inlet side of the air intake passage 17, and the nozzle jet is directed at the downstream side of the air intake passage 17.

IN THE OPERATION

As described above, according to the present invention, the metering chamber of a diaphragm type carburetor is connected to an accumulator via an electric primer pump, said accumulator being connected to the fuel tank via a relief valve and connected to a fuel nozzle disposed in an air intake passage of the carburetor via an electromagnetic valve. Therefore, when the primer pump is driven by the electric motor prior to starting of the engine, fuel in the metering chamber is moved into the accumulator, and fuel in the fuel tank is replenished into the metering chamber. Accordingly, even if fuel in the metering chamber is vaporized by heat immediately after the engine has been stopped and extremely reduced in quantity, fuel is replenished before starting, and therefore, the defective starting of the engine can be avoided.

When the key switch 45 and the connected switch 54 are closed, motor 36 is started and valve 110 is opened. This occurs simultaneously with cranking of the engine, causing fuel in the accumulator 120 to be injected as start-fuel from the fuel nozzle 14 to the air intake passage 17 of the carburetor, and therefore injected fuel is efficiently atomized and a mixture necessary for and sufficient for starting is supplied to the engine, thus providing the positive start of the engine and maintaining the operation after start.

What is claimed is:

1. An apparatus for supplying start-fuel in the internal combustion engine for a portable type working machine characterized in that a metering chamber of a diaphragm type carburetor is connected to an accumulator via an electric primer pump, said accumulator being connected to a fuel tank via a relief valve and connected to a fuel nozzle disposed in an intake passage of the carburetor via an electromagnetic valve.

2. An apparatus for supplying start-fuel in the internal combustion engine for a portable type working machine according to claim 1, wherein a temperature switch sensitive to heat of the engine to close a circuit at a temperature below a predetermined temperature and a start switch are connected in series to an energizing circuit of said electromagnetic valve.

3. An apparatus for supplying start-fuel in the internal combustion engine for a portable type working machine according to claim 2, wherein said start switch of the electromagnetic valve and a key switch of an electric motor are operatively interconnected.

4. An apparatus for supplying start fuel to an internal combustion engine for a portable type working machine in which a diaphragm carburetor has an air-fuel mixing passage with an air inlet, a metering chamber with conventional main and idle ports, a fuel supply tank, and a fuel pump to move fuel from said tank to said metering chamber, characterized in a supplemental fuel nozzle directed to said air inlet, a variable volume fuel reservoir in a conduit between said fuel nozzle and said fuel tank, power driven primer pump connected to said reservoir, a one-way connection between said metering chamber and said pump, a valve between said nozzle and said fuel reservoir to allow fuel, when said valve is closed, to enter said reservoir against a resilient bias when said pump is operated, and an electromagnetic means to open said valve in response to a starting action of the said engine, wherein rotation of said pump in one direction moves fuel from said metering chamber to said reservoir and actuation of said electromagnetic means with the cranking of the engine, causes fuel to move directly from said reservoir to said fuel nozzle.

5. An apparatus as defined in claim in which a relief valve is disposed in said conduit between said reservoir and said fuel tank.

* * * * *

UNITED STATES PATENT AND TRADEMARK OFFICE

CERTIFICATE OF CORRECTION

PATENT NO. : 4,862,847

DATED : September 5, 1989

INVENTOR(S) : Takeshi Kobayashi, Kohji Nagasaka, Yoshimi Sejimo

It is certified that error appears in the above-identified patent and that said Letters Patent is hereby corrected as shown below:

Col. 1, line 11, "237,946" should be --237, 964--.

Col. 5, line 16 before "power" insert --a--.

Col. 6, line 14, after "claim" insert --4--.

Signed and Sealed this

Thirty-first Day of July, 1990

*Attest:*

HARRY F. MANBECK, JR.

*Attesting Officer*

*Commissioner of Patents and Trademarks*